United States Patent [19]

Kimpel

[11] Patent Number: 4,803,589

[45] Date of Patent: Feb. 7, 1989

[54] ELECTROMAGNETIC RELAY

[75] Inventor: Rolf-Dieter Kimpel, Berlin, Fed. Rep. of Germany

[73] Assignee: Siemens Aktiengesellschaft, Berlin and Munich, Fed. Rep. of Germany

[21] Appl. No.: 1,979

[22] Filed: Jan. 9, 1987

[30] Foreign Application Priority Data

Jan. 20, 1986 [DE] Fed. Rep. of Germany ..... 3601519

[51] Int. Cl.[4] ..... H01H 47/00; H01H 9/00; H01F 5/00

[52] U.S. Cl. ..... 361/210; 335/181; 335/256

[58] Field of Search ..... 361/210, 31, 32; 335/180, 181256, 266

[56] References Cited

U.S. PATENT DOCUMENTS 549,209 11/1895 Penny ..... 361/210
3,238,326 3/1966 Frey ..... 335/261
4,376,271 3/1983 Gallatin et al. ..... 361/210

FOREIGN PATENT DOCUMENTS 1123339 8/1968 United Kingdom .
1532107 11/1978 United Kingdom .

*Primary Examiner*—L. T. Hix
*Assistant Examiner*—David Porterfield
*Attorney, Agent, or Firm*—Hill, Van Santen, Steadman & Simpson

[57] ABSTRACT

An electromagnetic relay includes a power supply element of the load circuit which is conducted around a part of the excitation flux circuit by at least one turn so that an auxiliary excitation flux is generated therein isodirectionally with the excitation flux of the winding. A reliable response of the relay is guaranteed even in relays wherein high currents are drawn by the load circuit from the same voltage source that delivers the excitation voltage, such as in relays in motor vehicles.

4 Claims, 2 Drawing Sheets

ELECTROMAGNETIC RELAY

BACKGROUND OF THE INVENTION

1. Field of the Invention

The present invention relates to an electromagnetic relay and, more particularly, to a relay with an excitation flux circuit for an armature.

2. Description of the Prior Art

When electromagnetic relays are switched, a problem occurs in certain applications where the excitation voltage for the relay coil or winding drops off during the attraction of the armature so that the armature is no longer fully attracted under certain conditions and can exhibit a fluttering motion. Accordingly, the switch contact operated by the armature is either not closed at all, or, after repeated interruptions, the switch does not remain closed. In particular, such problems occur in applications where the voltage source for the excitation winding of the relay simultaneously supplies current to the load circuit as well, for instance, as specifically occurs in motor vehicles. When certain elements, such as lamps or starters, are turned on, extremely high turn-on current peaks occur which can lead to a collapse of the voltage. Thus, reliable functioning of the relay is not guaranteed.

To guarantee a reliable response of the relay in such applications, the windings either had to be greatly overdimensioned, or the relay had to be rendered functional for the described applications by providing structural or fabrication related auxiliary measures, such as using permanent magnets or special adjustments. All of these things, however, mean an additional expense during manufacturing of the relay.

SUMMARY OF THE PRESENT INVENTION

An object of the present invention is to provide a reliable electromagnetic relay response for lower turn-on voltages, whereby the reliable response is guaranteed when the excitation winding and the load circuit are fed from the same voltage source and a high turn-on current through the load circuit leads to a collapse of the voltage at the excitation winding.

In accordance with the invention, at least one of the power supply elements connected to the switch contact is conducted around a part of the excitation flux circuit so that an auxiliary excitation is induced therein isodirectionally with the excitation of the winding.

By means of a simple and relatively slight structural modification of the power supply to the switch contact, a reliable response of the relay is guaranteed since the peak turn-on current in the load circuit which occurs simultaneously with the drop of the excitation voltage and causes the excitation voltage to collapse is used for generating an auxiliary excitation, given the use of a common voltage source for the excitation coil and the load circuit. Since, for a common voltage source, the turn-on current peak coincides immediately with the reduction of the excitation voltage and a recovery of the excitation voltage accompanies the reduction in the load current to the continuous current level, the present relay advantageously achieves a largely uniform level of excitation.

The auxiliary excitation that is generated by the load current is obtained in a simple structural way by winding at least one of the power supply elements around the yoke for at least one turn. The winding sense is, of course, selected in accordance with the wiring rule of the relay so that the auxiliary excitation is isodirectional with the coil excitation. In certain instances, the effect of the auxiliary excitation is achieved by a power supply element conducted between the winding and the yoke to form at least part of a winding around the yoke.

In a further development of the present invention, the auxiliary excitation that is generated by an appropriate guidance of the load current is sufficiently high that it exceeds the drop-off excitation value of the relay. Therefore, a self-holding effect is produced. In other words, the relay remains in its attracted condition even after the voltage to the excitation winding is discontinued. The relay does not drop-off again until an anti-excitation signal is produced. Thus, a bistable switch behavior is produced in a simple way for the present relay.

Figure 1:
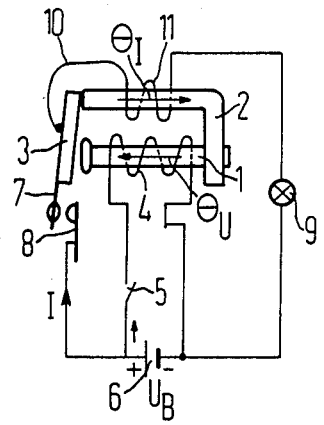
FIG. 1 is a schematic illustration of pertinent elements of a relay according to the principles of the present invention shown connected to a load circuit.

FIG. *2a* is a time diagram of current in the relay of FIG. 1 upon actuation of the relay;

FIG. *2b* is a time diagram of voltage in the relay of FIG. 1 corresponding to the actuation current diagram of FIG. *2a;*

FIG. *2c* is a time diagram of excitation flux in the relay of FIG. 1 corresponding to the actuation event shown in FIGS. *2a* and *2b;*

Figure 3:
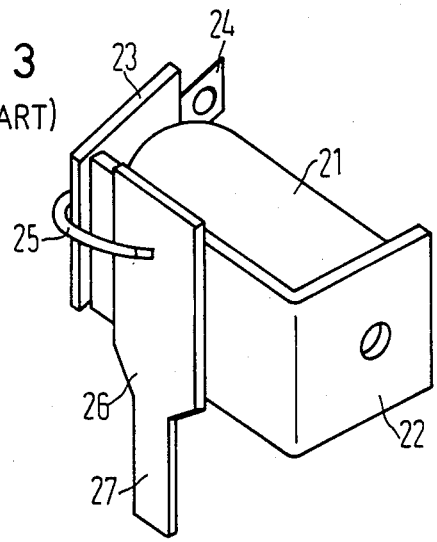
FIG 3 (PRIOR ART)
Figure 4:
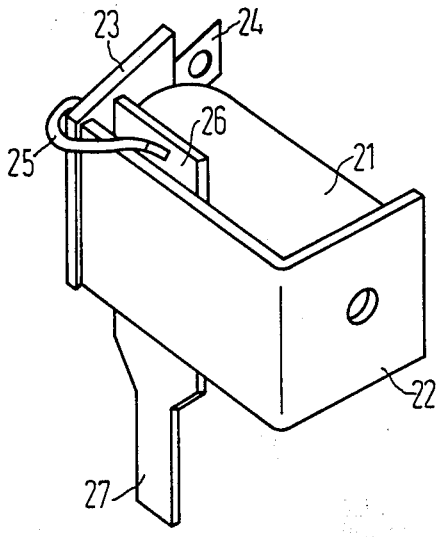

FIG. 3 is a perspective view of a prior art magnetic system for a relay; and FIG. 4 is a perspective view of a modification of the magnetic system of FIG. 3.

DESCRIPTION OF THE PREFERRED EMBODIMENTS

In FIG. 1, a schematic structure of a relay including a core 1, an angular yoke 2, and an armature 3, which together form a ferromagnetic excitation flux circuit, is shown. An excitation winding 4 is disposed about the core 1. The excitation winding 4 is capable of being connected to a DC voltage source 6 by a switch 5 so as to place the relay in operation and to attract the armature 3 toward the core 1. A contact formed by a contact spring 7 connected to the armature 3, and by a fixed contact element 8, is switched upon movement of the armature 3 toward the core 1. This closes a load circuit including a load 9 which is likewise connected to the voltage source 6. The fixed contact element 8 is usually anchored rigidly in the relay housing (not shown) and is provided with a terminal pin. The spring contact 7 is connected to a corresponding terminal element, usually by a flexible power supply element such as, for example, a stranded conductor 10.

When the switch 5 is closed, the relay is excited and the armature 3 is attracted so that the contact spring 7 and the fixed contact element 8 are closed. A current I then flows in the load circuit and generally reaches a high peak value during turn-on. The high turn-on peak current can lead to a temporary collapse of a volatge $U_B$ from the voltage source 6. This diminishes the voltage at the excitation winding 4 and lessens the excitation flux $\theta_B$. When the collapse of the excitation voltage $U_B$ at turn-on is excessively large, then the diminished excitation flux $\theta_B$ can possibly lead to the armature 3 no longer being fully attracted and the contacts 7 and 8 reopening. To prevent this, the power supply element 10 is wrapped preferably once or twice around the yoke to form a type of auxiliary winding 11 which generates an auxiliary excitation flux $\theta_I$ in the excitation circuit that depends upon the load current I. The armature 3 is, thus, reliably attracted in every instance.

Figure 2A:
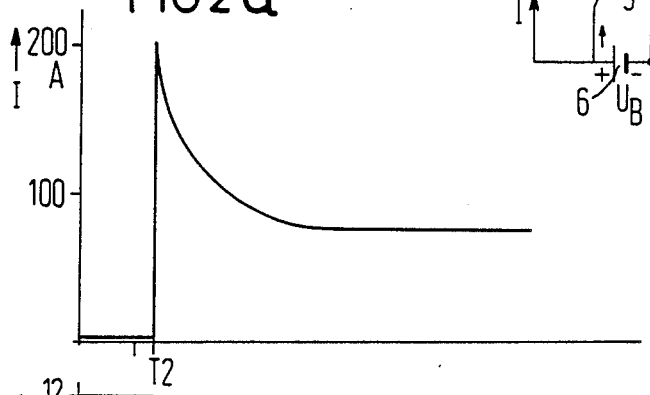
Figure 2B:
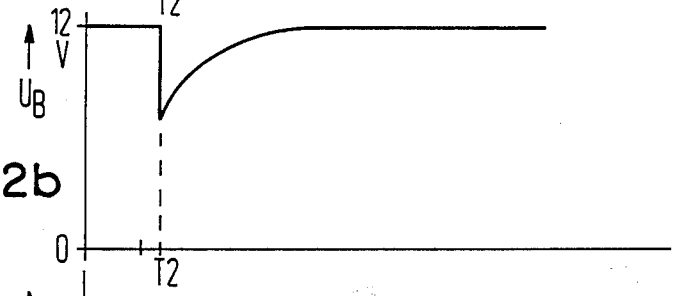
Figure 2C:
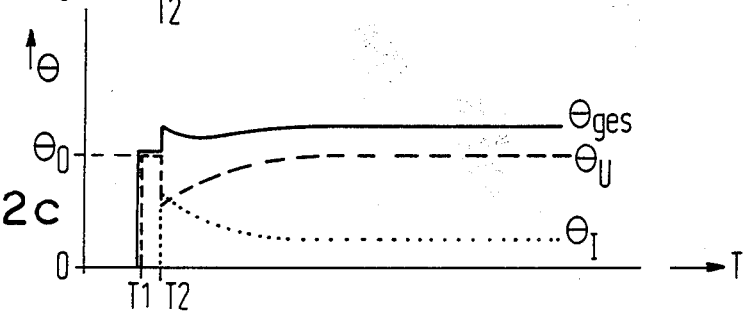

FIGS. 2*a*, 2*b*, and 2*c* show the chronological execution of a turn-on event for the relay of FIG. 1. The current I, the voltage $U_B$ for the voltage source, and the excitation flux $\theta$ are charted over a time axis T. When the switch 5 is closed at a point-in-time T1, the full battery voltage $U_B$ which, for example, is 12 volts, is at the excitation winding 4, as shown in FIG. 2*b*. A corresponding excitation current flows as can be seen in FIG. 2*a*, which generates an excitation flux $\theta_U$ that has a value of $\theta_0$, as shown in FIG. 2*c*. At a point in time T2, the contact between the contact spring 7 and the fixed contact 8 is closed and an extremely high current peak of, for example, 200 amps flows in the load circuit. For example, in a motor vehicle, the load circuit can be lamps, motors, or heating coils. Simultaneously, the battery voltage $U_B$ greatly decreases at the point-in-time T2, which leads to a corresponding drop in the excitation flux $\theta_2$ (shown by a broken line in FIG. 2*c*). However, an auxiliary excitation $\theta_I$ (shown by a dotted line in FIG. 2*c*) is simultaneously generated by the power supply element 10 which forms an auxiliary winding 11 by being wrapped around the yoke 2. The auxiliary excitation $\theta_I$ is added to the excitation $\theta_U$ to form an overall value of excitation flux $\theta_{GES}$ (shown by a solid line in FIG. 2*c*). The overall excitation $\theta_{GES}$ is adequate in any instance to reliably attract the armature 3. After the decay of the turn-on current peak, the voltage of the excitation winding 4 rises again, as does the excitation flux $\theta_U$ generated as a result thereof. The load current I and the auxiliary excitation $\theta_I$ both drop, such as to a steady-state value. The sum of the excitation flux $\theta_{GES}$ is largely uniform in the present invention. Therefore, a reliable functioning of the relay is assured without having to overdimension the winding.

FIGS. 3 and 4, by comparison, show how the switch behavior of a relay can be improved by the present invention by a simple structural modification. In FIG. 3, a relay coil 21 has an angular yoke 22 and an armature 23. The switching current is conducted to a contact spring 24 connected to the armature 23 by a stranded conductor 25 which, in turn, is electrically and mechanically connected to a power supply plate 26. The power supply plate forms a plug pin or solder pin 27 at its underside, which is attached to the outside of the yoke 22, in the illustrated example. Practically no magnetic excitation by the load current is produced in the yoke and in the excitation flux circuit.

In FIG. 4, the current supply plate 26 is connected instead to the inside of the yoke 22 by being conducted between the yoke 22 and the winding 21. Thus, the power supply plate 26 forms a part of the winding around the yoke 22, together with the stranded conductor 25. In this way, the high load current can induce an auxiliary excitation in the yoke 22, where proper orientation of the current direction is presumed. The wiring direction of the relay shown in FIG. 4 does not correspond exactly to the winding direction of the relay shown in FIG. 1. Thus, a particularly simple modification of a relay generates an auxiliary flux to improve relay operation.

Although other modifications and changes may be suggested by those skilled in the art, it is the intention of the inventor to embody within the patent warranted hereon all changes and modifications as reasonably and properly come within the scope of his contribution to the art.

I claim as my invention:

1. An electromagnetic relay having an excitation winding connectable to a voltage source ahd having a core within the winding forming an excitation flux circuit together with a yoke disposed outside of the winding to conduct electromagnetic flux in a first direction, an armature seated at the yoke forms a working air gap with a free end of the core, at least one switch contact being actuatable by the armature when said electromagnetic flux is conducted in the first direction, comprising:

power supply elements connecting the at least one switch contact to a load circuit and to the voltage source, the voltage source being connectable to the excitation winding, at least one of the power supply elements being conducted around a part of the excitation flux circuit substantially fewer times than the excitation winding so that current connected by said at least one switch contact from said voltage source to the load circuit flows through said power supply elements to produce an auxiliary excitation in said part isodirectionally with said first direction of said electromagnetic fluxes of the excitation winding, both said excitation winding and said load circuit being connected across said voltage source so that a peak load current caused by closing of said at least one switch contact flows through said power supply elements simultaneously with a drop in voltage across the excitation winding to add said auxiliary excitation to said electromagnetic flux of the excitation of said excitation winding thereby holding the armature closed during a drop in the flux of the excitation winding caused by the drop in voltage.

2. An electromagnetic relay as claimed in claim 1, wherein at least one of said power supply elements is a one piece extension of a terminal pin of the relay conducted between the excitation winding and the yoke.

3. An electromagnetic relay as claimed in claim 1, wherein said at least one power supply element is conducted no more than twice around said part of the excitation flux circuit.

4. An electromagnetic relay for switching a voltage to a load circuit, comprising:

a core for conducting a main electromagnetic flux;

a relay winding about said core to cause said main electromagnetic flux to be directed in a first direction when said relay winding is connected to the voltage source;

a yoke mounted adjacent said relay winding and forming a part of an electromagnetic flux circuit;

an armature disposed adjacent said yoke to complete said flux circuit and movable toward said core upon excitation of said relay winding by the voltage source;

a first switch contact mounted for movement with said armature;

a second switch contact mounted for engagement in a closed position with said first switch contact upon movement of said armature toward said core, said closed position of said first and second switch contacts connecting the voltage source to the load; and an auxiliary winding about said yoke and connected in circuit with said first and second switch contacts when in a closed position, said auxiliary winding being oriented to generate an auxiliary electromagnetic flux in said first direction in said flux circuit upon closing of said first and second switch contacts, said auxiliary electromagnetic flux being isodirectional with said main electromagnetic flux to maintain said armature in a position toward said core and thereby maintain said first and second switch contacts in a closed position during a voltage drop from the voltage source as the result of a turn-on current to the load circuit, said auxiliary winding including a power supply plate extending between said yoke and said relay winding through which current from the voltage source flows to the load circuit when said first and second switch contacts are in the closed position.

* * * * *